US006024154A

United States Patent [19]

Wang et al.

[11] Patent Number: 6,024,154

[45] Date of Patent: Feb. 15, 2000

[54] VENETIAN BLIND LIFTING MECHANISM PROVIDED WITH CONCEALED PULL CORDS

[75] Inventors: Wei-Cheng Wang, Tai Nan Hsien; Chen-Chin Cheng, Hsin Chu; Ray-Ten Chen, Hsin Chu; Ya-Wei Hsu, Hsin Chu, all of Taiwan

[73] Assignees: Industrial Technology Research Institute, Hsinchu; Nien Made Enterprises, Co., Ltd., Chang Hua Hsien, both of Taiwan

[21] Appl. No.: 09/239,155

[22] Filed: Jan. 28, 1999

[51] Int. Cl.[7] ..... E06B 9/30

[52] U.S. Cl. ..... 160/170; 160/168.1 R

[58] Field of Search ..... 160/170 R, 279, 160/192, 168.1 R, 84.04, 84.02

[56] References Cited

U.S. PATENT DOCUMENTS

| | | | |
|---|---|---|---|
| 794,937 | 7/1905 | Hopkins | 160/279 |
| 800,279 | 9/1905 | Emery | 160/279 |
| 5,105,867 | 4/1992 | Coslett | 160/192 |
| 5,170,830 | 12/1992 | Coslett | 160/192 |
| 5,482,100 | 1/1996 | Kuhar | 160/170 R |
| 5,531,257 | 7/1996 | Kuhar | 160/170 R |

*Primary Examiner*—Blair M. Johnson
*Attorney, Agent, or Firm*—Browdy and Neimark

[57] ABSTRACT

A Venetian blind lifting mechanism is composed of a slat set, a winding member, a slat winding cord, and a locating member. The slat set has a plurality of slats. The winding member has at least one cord pulling member and at least one spring releasing unit which is linked with the cord pulling member. The cord pulling member has one end which is extended through the slat set, and other end which is fastened with the cord pulling member. The locating member has a retaining member capable of bringing about a retaining force to overcome the rewinding force of the winding member so as to stabilize the cord pulling member.

17 Claims, 5 Drawing Sheets

VENETIAN BLIND LIFTING MECHANISM PROVIDED WITH CONCEALED PULL CORDS

FIELD OF THE INVENTION

The present invention relates generally to a Venetian blind, and more particularly to the Venetian blind having a lifting mechanism which is provided with concealed pull cords.

BACKGROUND OF THE INVENTION

The conventional Venetian blind is composed of a plurality of slats which can be operated by a lifting mechanism to ascend or descend. The lifting mechanism has an outer pull cord which is disposed outside the slats, a slat set pull cord, and a ratchet wheel retaining member. The outer pull cord is exposed to facilitate the pulling of the pull cord by hand. The slat set pull cord is connected with the slat set such that the slat set pull cord is actuated to control the ascending and the descending of the slat set. In the meantime, the slat set in motion is located at a desired level by the ratchet wheel retaining member.

Such a conventional Venetian blind as described above is defective in design in that the exposed pull cord is a potential safety hazard to a playful child who may be strangled accidentally by the pull cord, and that the exposed pull cord is prone to become entangled with a foreign object, and further that the exposed pull cord is vulnerable to becoming intertwined with the slat set.

SUMMARY OF THE INVENTION

It is therefore the primary objective of the present invention to provide a Venetian blind with a lifting mechanism which is provided with the concealed pull cords to enhance the safety of the lifting mechanism, as well as the controllability of the lifting mechanism.

It is another objective of the present invention to provide a Venetian blind with a lifting mechanism which is relatively simple in construction which winds the blind cords when the blind is ascending.

In keeping with the principle of the present invention, the foregoing objectives of the present invention are attained by a Venetian blind lifting mechanism which is provided with two concealed pull cords and is composed of a slat set, a winding member, the two concealed pull cords, and a locating member. The slat set has a plurality of slats. The winding member has at least one cord-pulling member and at least one spring releasing unit which is linked with the cord-pulling member. The slot winding cord has one end which is put through the slat set, and other end which is fastened with the cord-pulling member. The locating member has a retaining member capable of bringing about a retaining force to overcome the rewinding force of the winding member so as to stop winding of the slat winding cord around the cord-pulling member.

The foregoing objectives, features and functions of the present invention will be more readily understood upon a thoughtful deliberation of the following detailed description of the embodiments of the present invention with reference to the accompanying drawings.

DETAILED DESCRIPTION OF THE INVENTION

Figure 1:
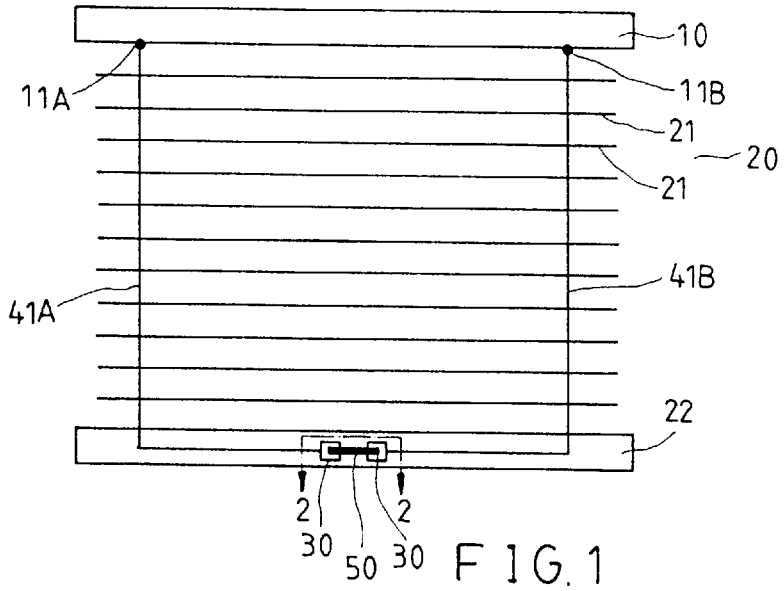
FIG. 1 shows a front view of a first preferred embodiment of the present invention.
Figure 2:
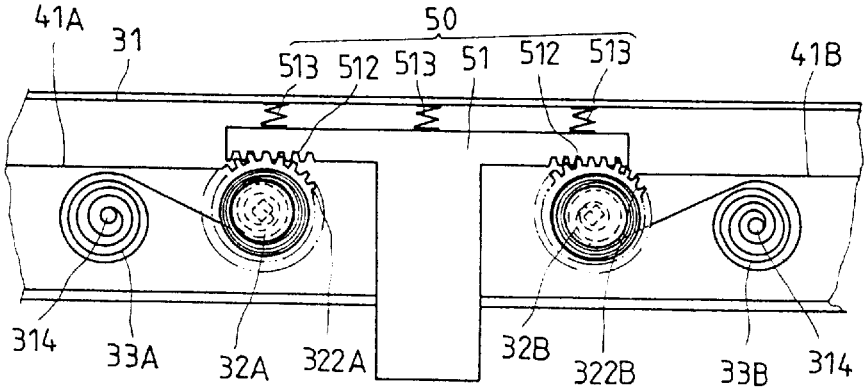
FIG. 2 is a sectional view taken along a line 2—2, as shown in FIG. 1, to show the enlarged schematic views of the winding member and the locating member.
Figure 3:
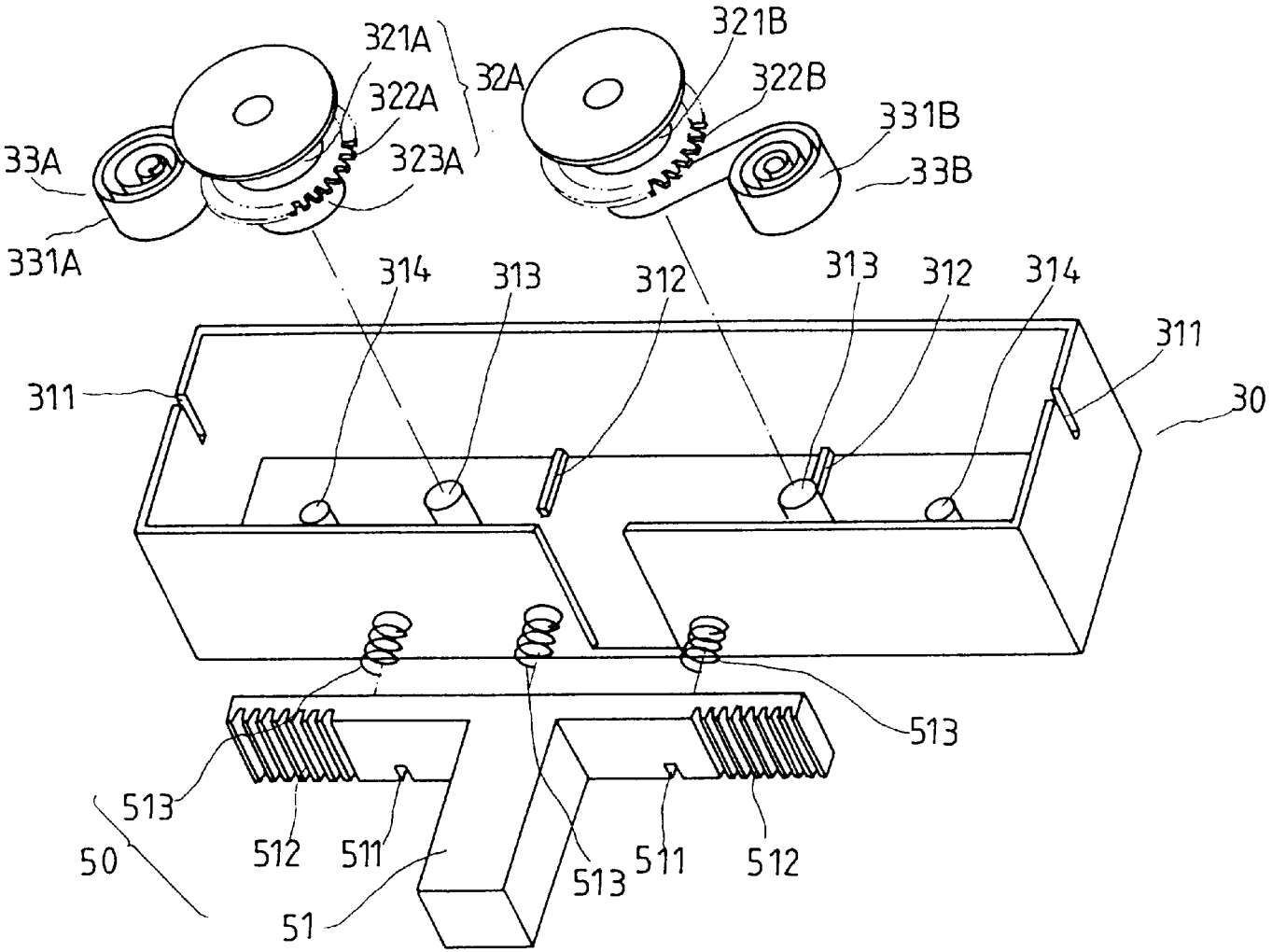
FIG. 3 shows an exploded view of FIG. 2.

As shown in FIGS. 1–3, a Venetian blind lifting mechanism embodied in the present invention is composed of a frame 10, a slat set 20, a winding member 30, and a locating member 50.

The frame 10 is located at the top of the Venetian blind for fastening the Venetian blind with a window. The frame 10 is provided at both ends of the bottom thereof with two fastening portions 11A and 11B.

The slat set 20 is composed of a plurality of slats 21 and is provided in the bottommost side thereof with a lower rail 22. The total weight of the slat set 20 is denoted by W.

The winding member 30 has a case 31 which is disposed in the lower rail 22 of the slat set 20 and is provided therein with two cord retrieving and winding members 32A and 32B, and two spring releasing units 33A and 33B. The case 31 is provided at both sides thereof with a line slot 311, and in the bottom thereof with two guide rails 312, two first fastening shafts 313, and two second fastening shafts 314. Each of the cord retrieving and winding members 32A and 32B is a rotary wheel, which is mounted pivotally on the first fastening shaft 313 and is provided with a winding portion 321A, 321B, a retaining portion 322A, 322B, and an insertion portion 323A, 323B. The winding portion 321A(321B) is intended to mount the cord 41A, 41B when wound on members 32A and 32B. The retaining portion 322A(322B) is a gear. The insertion portion 323A(323B) is intended to engage one end of the spring releasing unit 33A(33B) and first fastening shafts 313. The spring releasing unit 33A (33B) comprises a coil spring 331A(331B) whose inner end is fastened with the second fastening shaft 314 and whose outer end is fastened with the insertion portion 323A(323B) of the cord retrieving member 32A(32B). The coil springs 331A and 331B has a a releasable winding force denoted as R. The winding force is used partially to overcome the friction force which is brought about by the winding motion of the pull cord. The winding force is also used partially to provide the force that is needed to raise the slat set when the locating member 50 is disengaged from the retaining portions 322A 322B. Preferably, the releasable winding force is as close as the weight of the slat set.

The slot pull cord comprises two pull cords 41A and 41B, which are fastened at one end thereof with the fastening portions 11A and 11B of the frame 10 such that other end thereof is wound downwards through each slat 21 to be in the lower rail 22 in which it is put through each line slot 311 of the case 31 to be wound on the winding portions 331A and 321B of the cord retrieving member 32A and 32B as the blind ascends. As a result, the pull cords 41A and 41B have a rewinding force.

The locating member 50 has a retaining member 51, which is located over the two cord retrieving and winding members 32A and 32B of the winding member 30. The retaining member 51 is provided in the bottom thereof with two guide slots 511, which are disposed on the guide rail 312 of the case 31 so as to enable the retaining member 51 to move in a constant linear direction without moving aside. The retaining member 51 is provided in a front side thereof with a rack 512, and in a rear side thereof with a plurality of springs 513. By being urged by each spring 513, the retaining member 51 in the normal state enables the rack 512 to engage the gears of the insertion portions 323A and 323B of the cord retrieving members 32A and 32B. A retaining force (F) given forth by the locating member 50 against the winding member 30 overcomes the winding force (R) of the coil springs 331A and 331B, thereby enabling the pull cord to be stopped and the slots located at will in the midst of being raised or lowered.

As shown in FIGS. 1 and 2, the retaining member 51 of the locating member 50 is pressed by hand to initiate the ascending or the descending of the slats. While descending when locating member 50 is disengaged the coil springs are biased by the winding of cords 41A and 41B around retrieving and winding members 32A and 32B due to the weight of the slats and the hand of the user pressing down. In the meantime, the rack 513 of the retaining member 51 is disengaged from the retaining portions 322A and 322B of the cord retrieving members 32A and 32B. As a result, cords 41A and 41B are no longer being exerted on by the retaining force of the locating member 50. As the hand of the mover is moved upwards, raising of the assisted the slat set is in view of the fact that the pull cords 41A and 41B have a rewinding force.

The retaining member 51 is also pressed with hand in order to cause the slats to move lower. The winding member 30 is no longer held on by the retaining force of the locating member 50. In the meantime, the weight of the slat set cancels out most of the upward rewinding force of coil springs 331A and 331B on the pull cords 41A and 41B. The slats can be easily caused to descend by exerting a pull force which is slightly greater than the force of application causing the slats to ascend. The slats in motion can be stopped and located at will by releasing the retaining member 51.

Figure 4:
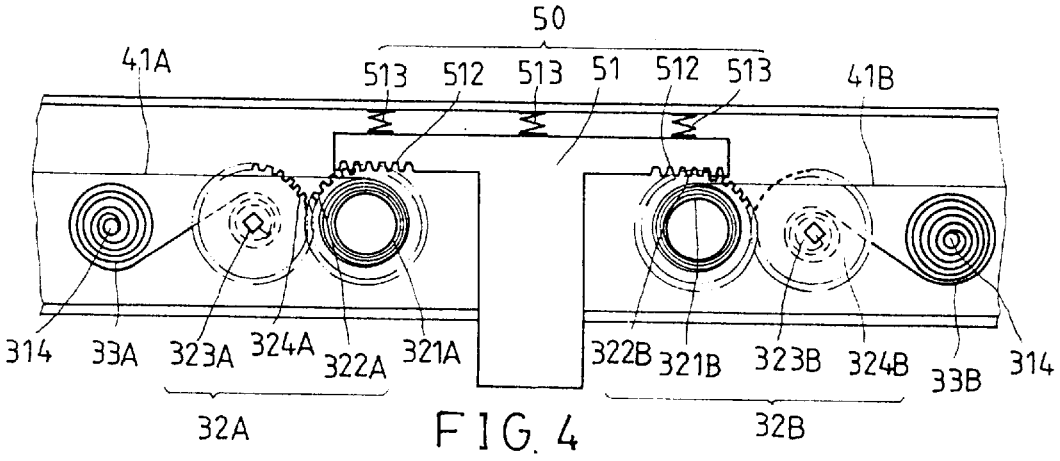
FIG. 4 shows an enlarged schematic view of the winding member and the locating member of a second preferred embodiment of the present invention.
Figure 5:
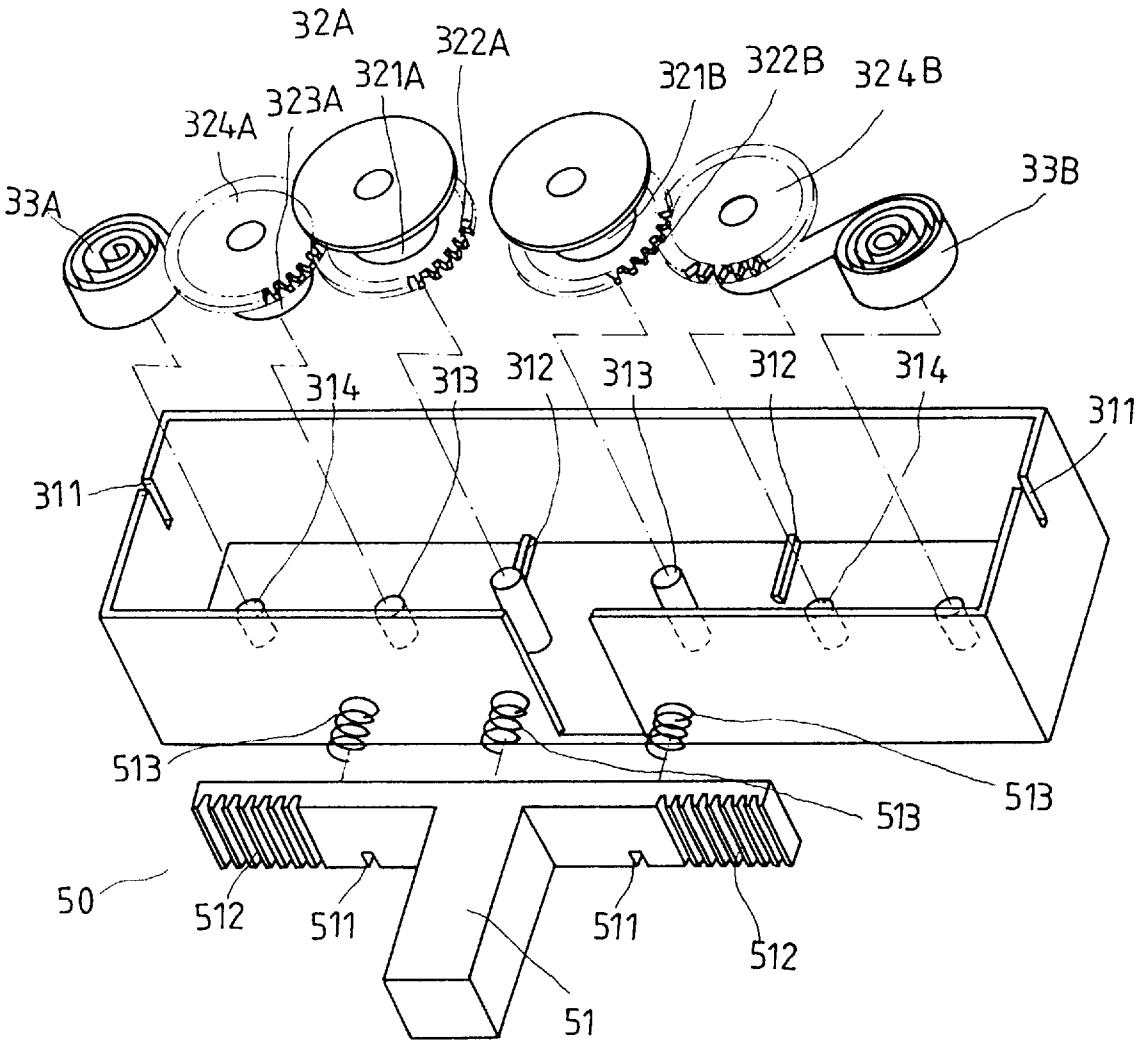
FIG. 5 shows an exploded view of FIG. 4.

As shown in FIGS. 4 and 5, the second preferred embodiment of the present invention is different from the first preferred embodiment of the present invention in that the insertion portions 323A and 323B of the cord retrieving and winding members 32A and 32B and transmission gear portions 324A and 324B of the former form an independent rotary wheel. As a result, the second preferred embodiment is provided with two rotary wheels in contrast with one rotary wheel of the first preferred embodiment, so as to reduce the height of the rotary wheel.

Figure 6:
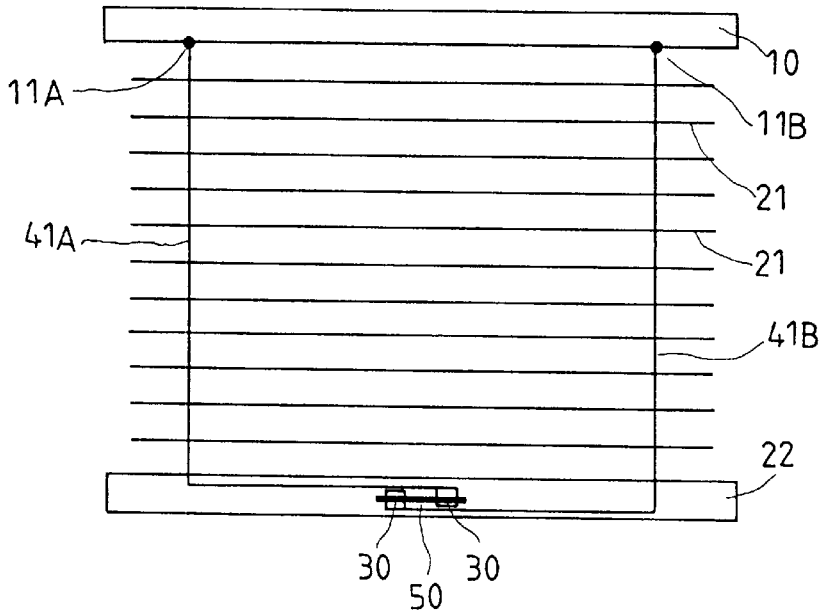
FIG. 6 shows a front view of a third preferred embodiment of the present invention.
Figure 7:
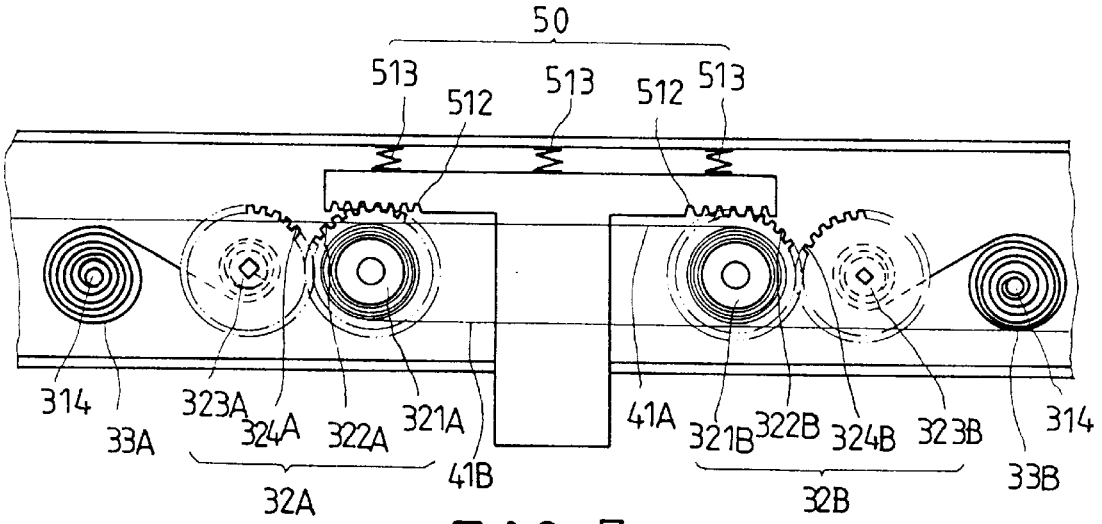
FIG. 7 shows an enlarged schematic view of the winding member and the locating member of the third preferred embodiment of the present invention.

As shown in FIGS. 6 and 7, the third preferred embodiment is different from the second preferred embodiment in that the pull cords 41A and 41B of the former are mounted on the corresponding winding sets 30A so as to balance the winding effect.

Figure 8:
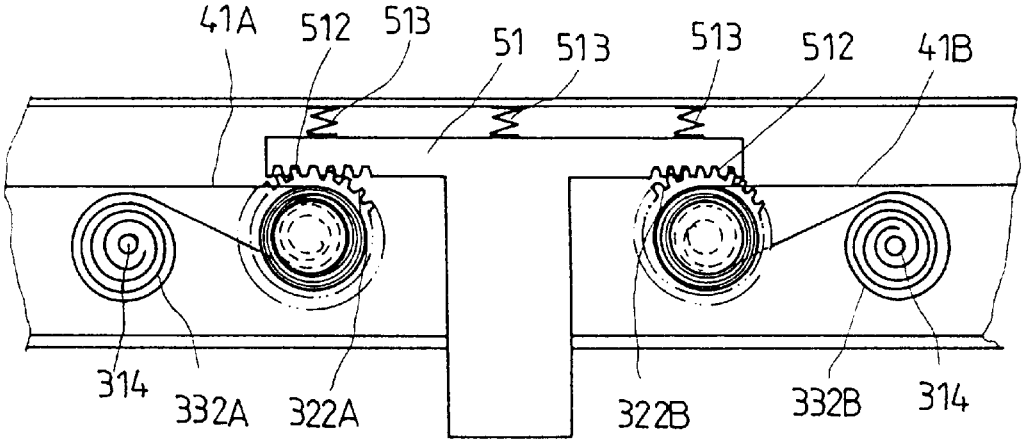
FIG. 8 shows a sectional view of a fourth preferred embodiment of the present invention.

As shown in FIG. 8, the fourth preferred embodiment is different from the first preferred embodiment in that the spring releasing units 33A and 33B of the former are respectively a constant torsional moment spring 332A (332B), which are fastened at one end thereof with the insertion portions 323A and 323B of the cord retrieving and winding members 32A and 32B such that other end thereof is freely fitted over the second fastening shaft 314. (This is different in nature and installation from the ordinary coil spring.) The torsional moment springs 332A and 332B of FIG. 8 have a fixed end and a storage end in the free state. In view of the fact that the constant torsional moment springs are capable of providing a constant elastic force even if the springs are curved, they have a constant rewinding force in relation to the cord retrieving and winding members 32A and 32B. The rewinding force is greater than the weight of the slat set.

Figure 9:
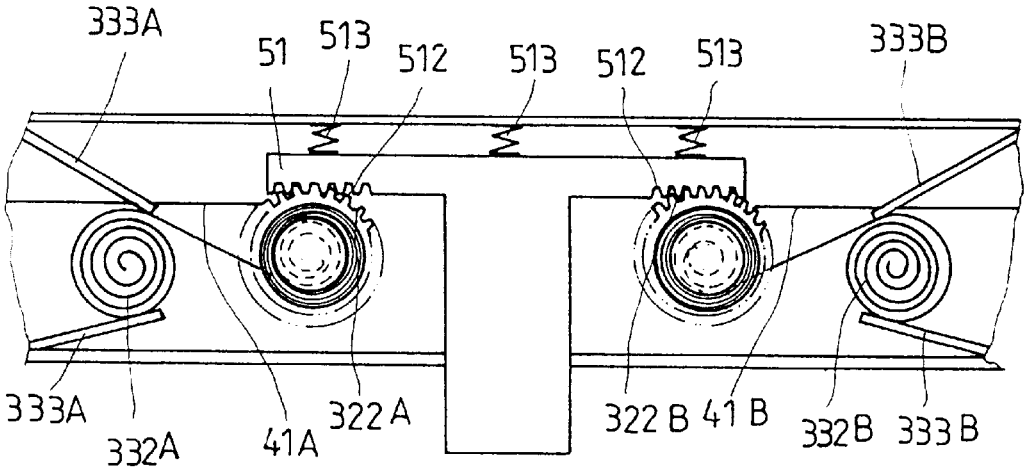
FIG. 9 shows a sectional view of a fifth preferred embodiment of the present invention.

As shown in FIG. 9, the fifth preferred embodiment of the present invention is different from the fourth preferred embodiment in that the constant torsional moment springs 332A and 332B of FIG. 9 are confined by two arresting pieces 333A and 333B such that the storage ends of the springs 332A and 332B are in the free state, and that the springs 332A and 332B are not fitted over a second fastening shaft 314, as long as they are capable of bringing about the linking effect on the cord retrieving members 32A and 32B having pull cords 41A and 41B.

The present invention has pull cords different in number in accordance with the windows of various widths, thereby resulting in an increase in number of the cord retrieving member. The retaining member of the locating member and the retaining member of the locating member may be a ratchet wheel mechanism capable of releasing unidirectionally. As a result, the slats can be raised without operating the retaining member. The present invention is therefore to be limited only by the scopes of the following appended claims.

What is claimed is:

1. A lifting mechanism for a venetian blind having at least a pair of concealed pull cords engaged to a plurality of slats, said lifting mechanism comprising;

a winding member having at least one cord retrieving and winding member and at least one spring releasing unit;

said spring releasing unit being operatively engaged with said cord retrieving and winding member;

each of said pair of concealed pull cords having a first end extending through said plurality of slats;

said cord retrieving and winding member fastened to a second end of each of said pair of concealed pull cords;

said spring releasing unit comprising a spring and having a spring biased position which allows said cord retrieving and winding member to rewind said pair of concealed pull cords after said blind has been pulled down to close;

a locating member having a retaining member said cord retrieving winding member to hold said spring releasing unit in said spring biased position to preclude rewinding of said pair of concealed pull cords; and wherein said locating member is adapted to hold said plurality of slats in an open position against a weight of said plurality of slats.

2. The lifting mechanism as defined in claim 1, wherein said winding member and said locating member are disposed at a bottommost side of said plurality of slats.

3. The lifting mechanism as defined in claim 1, wherein said first end of said pair of pull cords are fastened with a left side and a right side of a venetian blind frame, and at said second end thereof with said cord retrieving and winding member.

4. The lifting mechanism as defined in claim 1, wherein said cord retrieving and winding member comprises:

a winding portion for winding said pair of pull cords;

a retaining portion for engaging said retaining member of said locating member; and an insertion portion for fastening an end of said spring releasing unit.

5. The lifting mechanism as defined in claim 4, wherein said retaining portion of said cord retrieving and winding member is of a gearlike construction; and wherein said retaining member is provided on a first side thereof with a rack, and a second side thereof is urged by a spring such that said rack is engaged with said retaining portion when said retaining member is in a normal state.

6. The lifting mechanism as defined in claim 5, wherein said retaining member of said locating member is confined to move only in a linear direction by a housing for said lifting mechanism.

7. The lifting mechanism as defined in claim 6, wherein said retaining member is provided with at least one linear guide slot traversing a linear guide slot on a said housing.

8. The lifting mechanism as defined in claim 4, wherein said winding portion, said retaining portion and said insertion portion are disposed on a rotary wheel.

9. The lifting mechanism as defined in claim 4, wherein said cord retrieving and winding member is provided with a transmission portion; wherein said insertion portion is disposed on a first rotary wheel; wherein said winding portion and said retaining portion are disposed on a second rotary wheel; and wherein said transmission portion imparts a rewinding force of said spring releasing unit to said spring releasing unit to said winding portion.

10. The lifting mechanism as defined in claim 1, wherein said spring releasing unit has a coil spring.

11. The lifting mechanism as defined in claim 1, wherein said spring releasing unit has a constant torsional moment spring.

12. The lifting mechanism as defined in claim 11, wherein said spring is fastened at a first end thereof with said cord retrieving and winding member while a second end thereof is free.

13. The lifting mechanism as defined in claim 1, wherein said retaining member of said locating member and said retaining portion of said cord retrieving and winding member are a ratchet wheel mechanism.

14. A lifting mechanism for a venetian blind having at least a pair of concealed pull cords engaged to a plurality of slats, said lifting mechanism comprising;

a winding member having at least one cord retrieving and winding member and at least one spring releasing unit;

said spring releasing unit being operatively engaged with said cord retrieving and winding member;

each of said pair of concealed pull cords having a first end extending through said plurality of slats;

said cord retrieving and winding member fastened to a second end of each of said pair of concealed pull cords;

said spring releasing unit comprising a spring and a spring biased position which allows said cord retrieving and winding member to rewind said pair of concealed pull cords after said blind has been pulled down to close;

a locating member having a retaining member said cord retrieving and winding member to hold said spring releasing unit in said spring biased position to preclude rewinding of said pair of concealed pull cords; and wherein said locating member is adapted to hold said plurality of slats in an open position against a weight of said plurality of slats;

a retaining portion for engaging said retaining member of said locating member;

wherein said retaining portion of said cord retrieving and winding member is of a gearlike construction; and wherein said retaining member is provided on a first side thereof with a rack, and a second side thereof is urged by a spring such that said rack is engaged with said retaining portion when said retaining member is in a normal state.

15. The lifting mechanism as defined in claim 14, wherein said retaining member of said locating member is confined to move only in a linear direction by a housing for said lifting mechanism.

16. The lifting mechanism as defined in claim 15 wherein said retaining member is provided with at least one linear guide slot traversing a linear guide slot on a said housing.

17. The lifting mechanism as defined in claim 14, wherein said retaining member of said locating member and said retaining portion of said cord retrieving member are a ratchet wheel mechanism.

* * * * *

UNITED STATES PATENT AND TRADEMARK OFFICE

CERTIFICATE OF CORRECTION

PATENT NO. : 6,024,154
DATED : February 15, 2000
INVENTOR(S) : Wei-Cheng Wang et al.

It is certified that error appears in the above-identified patent and that said Letters Patent is hereby corrected as shown below:

Column 4,
Line 52, after "member", insert -- engaging --.

Column 6,
Line 17, after "member", insert -- engaging --.

Signed and Sealed this

Ninth Day of December, 2003

JAMES E. ROGAN
*Director of the United States Patent and Trademark Office*